US005653408A

United States Patent [19]

Kuhn et al.

[11] Patent Number: 5,653,408

[45] Date of Patent: Aug. 5, 1997

[54] DIRECT SUPPORT FROG ASSEMBLY

[75] Inventors: Stephen R. Kuhn, Richton Park, Ill.; Ronald Lee Lancaster, Manitou Springs, Colo.; Ted A. Rittenhouse, Frankton, Ind.; Kenneth L. Schultz, Orland Park; Keith Young, Naperville, both of Ill.

[73] Assignee: ABC Rail Products Corporation, Chicago, Ill.

[21] Appl. No.: 635,876

[22] Filed: Apr. 18, 1996

[51] Int. Cl.[6] ..... E01B 7/00

[52] U.S. Cl. ..... 246/470

[58] Field of Search ..... 246/454, 458, 246/468, 469, 470, 471, 462, 463, 472

[56] References Cited

U.S. PATENT DOCUMENTS 2,739,772 3/1956 Budin ..... 246/470

5,496,004 3/1996 Kuhn ..... 246/470

5,522,570 6/1996 Benenowski et al. ..... 246/470

FOREIGN PATENT DOCUMENTS 372695 3/1961 Switzerland ..... 246/469

*Primary Examiner*—Mark T. Le

*Attorney, Agent, or Firm*—Thomas S. Baker, Jr.

[57] ABSTRACT

A direct support type of rigid railbound railroad trackwork frog assembly is provided with a core frog casting, a pair of compliant, non-metallic spacer elements contacting laterally opposed sides of the core frog casting, a pair of wing rails respectively contacting the compliant, non-metallic spacer elements, and a threaded bolt and nut fastener joining the casting, spacer elements, and wing rails into a rigid unitary structure.

9 Claims, 3 Drawing Sheets

DIRECT SUPPORT FROG ASSEMBLY

FIELD OF THE INVENTION

This invention relates generally to railroad trackworks, and particularly concerns a direct support type of rigid railbound frog assembly which obtains important maintenance and manufacturing advantages in comparison to known railroad trackwork frog assemblies.

BACKGROUND OF THE INVENTION

This invention relates generally to direct support type railroad trackwork frog assemblies such as the known frog assembly disclosed in co-pending application for U.S. Letters Patent Ser. No. 081516,504, filed Aug. 17, 1995 now U.S. Pat. No. 5,496,004 and assigned to the assignee of this application.

It has been observed in connection with known railroad trackwork frog assemblies that the threaded bolt and nut fasteners utilized to join the assembly wing rails and the assembly core frog casting into a unitary structure often become loosened as a result of assembly use and also as a result of thermal expansion and contraction. Conventional nut-locking features combined with the threaded fasteners do not function satisfactorily and as a result periodic maintenance re-tightening of the assembly fasteners is frequently required during the service life of each such assembly.

Also, it has been common practice to manufacture and machine a different size of assembly core frog casting for each frog assembly having a different size of wing rail components. By way of example, in instances where frog assemblies were offered for trackwork applications involving six different sizes of A.R.E.A. standard trackwork rail sections it has been the practice to design, cast, and machine at least six different sizes (configurations) of a core frog casting. Such practice has resulted in substantial unnecessary pattern making, machining, inventorying, and maintenance costs being incurred by the manufacturer of the frog assemblies.

We have discovered that the maintenance and manufacturing shortcomings associated with the prior art approaches to design and construction of rigid railbound frog assemblies may be overcome through a practice of our invention.

Other objects and advantages of our invention will become apparent from consideration of the drawings and detailed descriptive materials which follows.

SUMMARY OF THE INVENTION

The direct support type frog assembly of the present invention is basically comprised of a machined core frog casting having laterally-projecting integral spacer lug elements, a pair of spacer elements that co-operate with the spacer lug features machined into the frog casting, a pair of wing rail elements that co-operate with the molded spacer elements, and threaded bolt and nut fasteners that join the casting, spacer element, and wing rail components into a unitary structure.

The invention frog assembly also includes a base plate element which functions to directly support each the wing rail elements and the core frog casting if the wing rail elements have the same sectional height as the height of the core frog casting, and functions to directly support the wing rail elements and support the core frog casting through interposed riser elements in cases where the wing rail sections joined to the core frog casting have a sectional height that is greater than the height of the casting. Also, it is important that the distance from the co-planar wheel tread surfaces of the wing rail elements and the core frog casting to the center of the holes or openings provided in such elements for receiving the threaded fastener be a constant preselected distance, and that such holes or openings be oversized in comparison to the diameter of the threaded fasteners.

DETAILED DESCRIPTION

Figure 1:
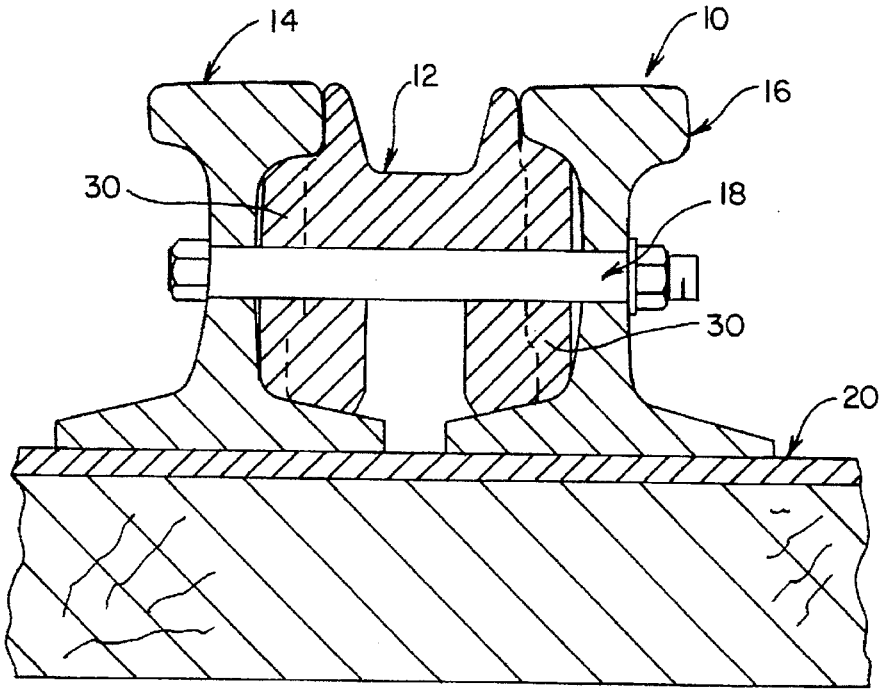
FIG. 1 PRIOR ART
FIG. 1 is a cross-sectioned elevation view of a prior art rigid railbound frog assembly taken at one of the assembly's longitudinally-intermittent fit pad positions.

FIG. 1 illustrates a heretofore widely utilized type of railroad trackwork frog assembly 10 basically comprised of a core frog casting 12, a pair of wing rail elements 14, 16 contacting the frog casting, and a threaded nut and bolt fastener assembly 18 which secures components 12 through 16 in their joined relation. Assembly 10 also includes a base element 20 which directly supports wing rails 14, 16 but supports frog casting 12 only indirectly through the wing rail elements. Casting 12 is provided with integrally cast fit pad elements 30 which are intermittently spaced along the longitudinal extent of assembly 10.

One side of each wing rail element 14, 16 partially wraps around the body of casting 12. Integrally cast fit pad elements 30 extend from opposite sides of the casting and are machined to complement the fishing surfaces formed on the bases and heads of wing rails 14, 16 as well as the webs of these rails. With this configuration, frog casting 12 is supported upon the fishing surfaces of the raid bases along the entire length of the casting. Rolling stock loads borne by the tread surfaces of casting 12 are transmitted downward through the vertical side walls of the casting and into the rail bases. Because the rail flanges support the frog casting, the cyclical loading caused by successive rail car wheels causes a grating action between the mating surfaces of the bottom of the frog casting and the fishing surfaces on the wing rail bases. This action causes both surfaces to abrade which ultimately results in the frog assembly becoming loose. Additionally, a portion of the vertical load on the frog casting imposed on the fishing surfaces of the rail bases results in opposed lateral forces acting to bias the wing rails apart. These forces impose a tensile loading on the bolts which clamp the rails to the frog casting. The cyclical tensile loading may result in failure of the bolt assembly which as a minimum forces replacement of the bolt assembly and may cause failure of the entire frog assembly. Grating action between the base of the frog casting and the wing rail fishing surfaces and the imposition of tensile forces on the bolts clamping the rails to the casting are avoided in direct support railbound frog assembly originated by applicants and illustrated in FIGS. 2 through 4.

The improved rigid railbound direct support type frog assembly of this invention is generally referenced by the numeral 100 in the drawings. Such assembly is in part comprised of a core frog casting 112 which is directly supported by a base plate element 120, a pair of wing rails 114, 116 which also are directly supported by base plate element 120, and threaded nut and bolt fastener sub-assembly 118. Also included in assembly 100 are a pair of spacer elements 117 and 119 which function to separate wing rails 114 and 116 from direct contact with core frog casting 112. Spacer elements 117 and 119 are each preferably formed of a compliant, non-metallic material such as a polyurethane resin, polyamide resin, or comparable material, optionally including a fibrous reinforcement. The spacer element also may be constructed of a compliant metallic material such as aluminum or bronze. The aforementioned materials have an ultimate compressive stress value somewhat less than that of the metals which comprise components 112, 114, 116, 118, and 119. Although preferably the spacers are molded they also may be cast, machined or otherwise manufactured. The use of the indicated compliant material for the spacer elements is believed to be the source of significantly reducing the frequency of having to properly re-tighten bolt sub-assemblies during the course of the service life of each assembly 100. It should be noted in FIG. 2 (and also in FIG. 3) that the holes or openings 121 provided in components 112, 114, 116, 117, and 119 for co-operation with sub-assembly 118 provide the necessary clearance with respect to the cross-sectional diameter of nut and bolt sub-assembly 118. Such assembly feature precludes the possibility of any vertical displacement of core frog casting during frog assembly use from introducing shear stresses into fastener sub-assembly 118.

Figure 2:
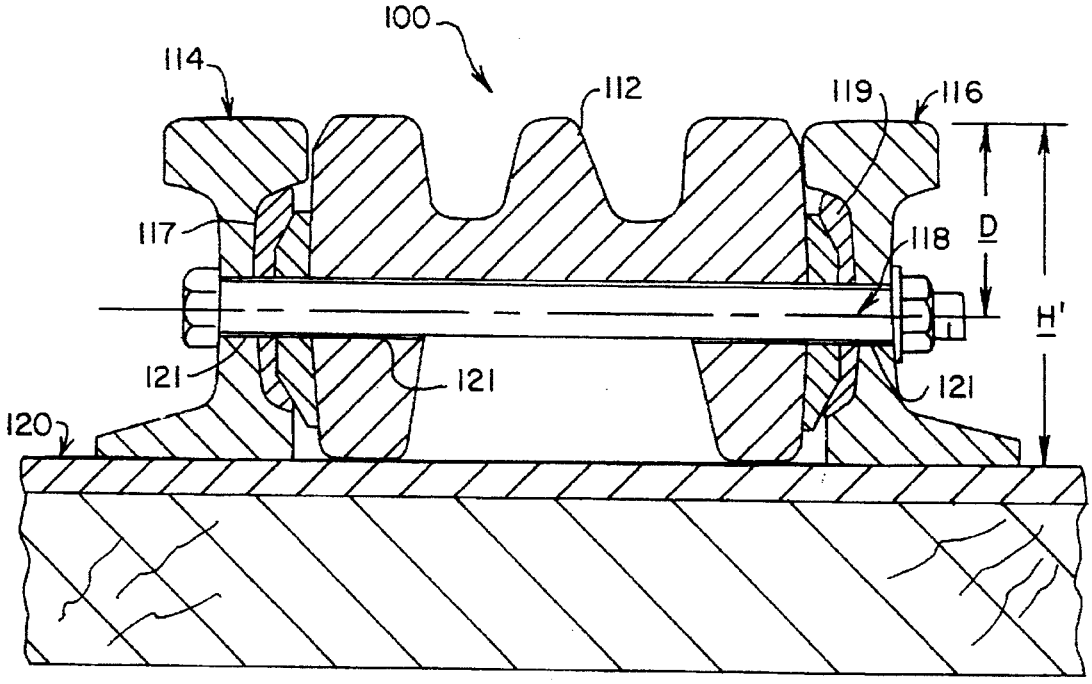
FIG. 2 is a cross-sectioned schematic elevation view illustrating a preferred embodiment of the direct support type frog assembly of the present invention taken at one of the assembly's longitudinally-intermittent spacer lug positions.
Figure 3:
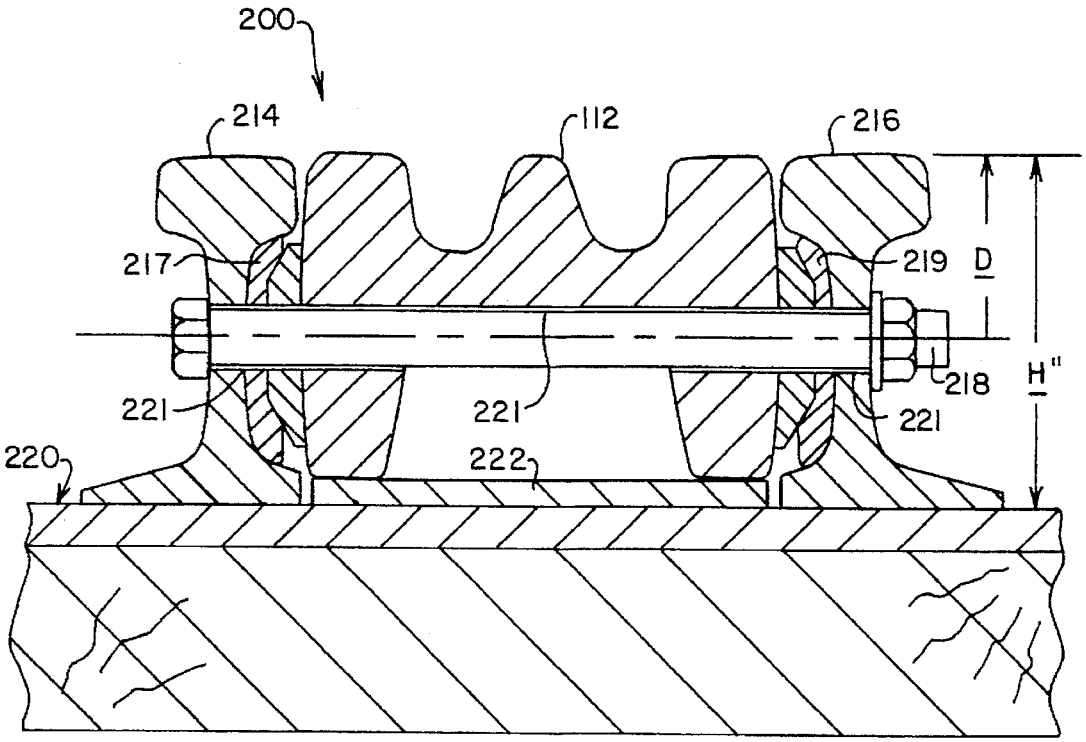
FIG. 3 is a cross-sectioned schematic elevation view similar to the view of FIG. 2 except that the wing rail elements incorporated into the assembly have a greater sectional height than the sectional height of the FIG. 2 wing rail elements.
Figure 4:
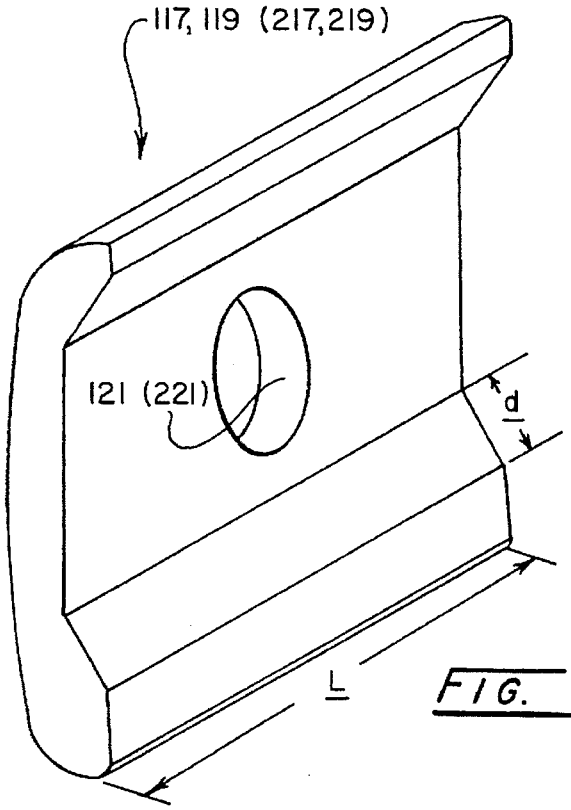
FIG. 4 is a schematic perspective view of a spacer element of the type used in the direct support frog assemblies of FIGS. 2 and 3.

The direct support frog assembly 200 illustrated schematically in FIG. 3 differs from the FIG. 2 illustration primarily with respect to the size of the included wing rail elements. Basically, the height H" of each wing rail 214, 216 is greater than the height H' of each of wing rails elements 114, 216 by an amount equal to the thickness of added riser element 222. By way of example, if wing rails 114, 116 are each A.R.E.A. Standard 115 RE rails and wing rails 214, 216 are selected to the Standard 140 RE rails, each riser element 222 incorporated in assembly 200 will have a thickness which compensates for the difference in rail height.

Spacer elements 217 and 219 included in assembly 200 may be molded similarly to spacer elements 117 and 119 except that their curved outermost interface surfaces are formed to substantially complement the innermost fishing and web surfaces of their co-operating wing rails 214, 216. Also, it is preferred that the distance D from the plane of the co-planar tread surfaces of components 212 through 216 to the centerline of bolt holes 221 be the same distance D from a corresponding plane in assembly 100 to the centerline of holes 221. If it becomes necessary in connection with either assembly 100 or assembly 200 to make adjustments in the effective spacing thicknesses of components 117, 119, or 217, 219 such as to accommodate variations in the web thickness of the co-operating wing rails induced during the manufacture of the rails, it is only necessary to mill or otherwise change the depth d (see FIG. 4) of the engagement slot provided in a spacer element for ultimate co-operation with a machined integral spacer lug element 112 included in core frog casting 112 or 212. For most applications we prefer that the longitudinal length L of an assembly spacer element be approximately four inches.

Figure 6:
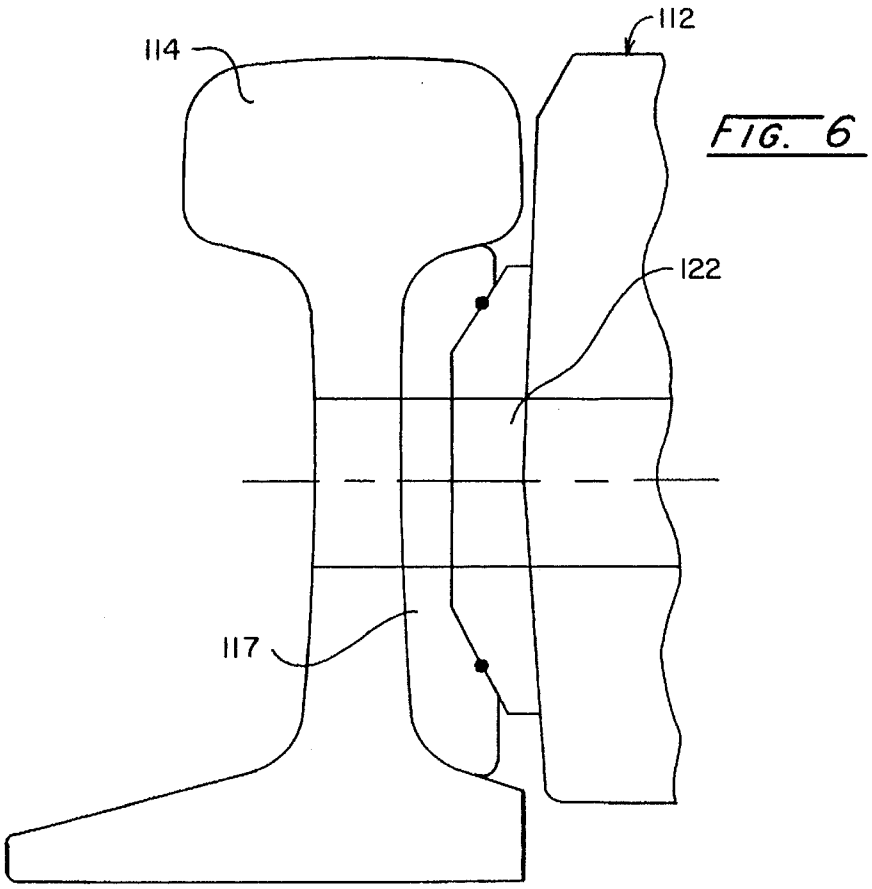
FIG. 6 is a view similar to FIG. 5 but illustrating the direct support type frog assembly in a fully-tightened assembled condition.
Figure 5:
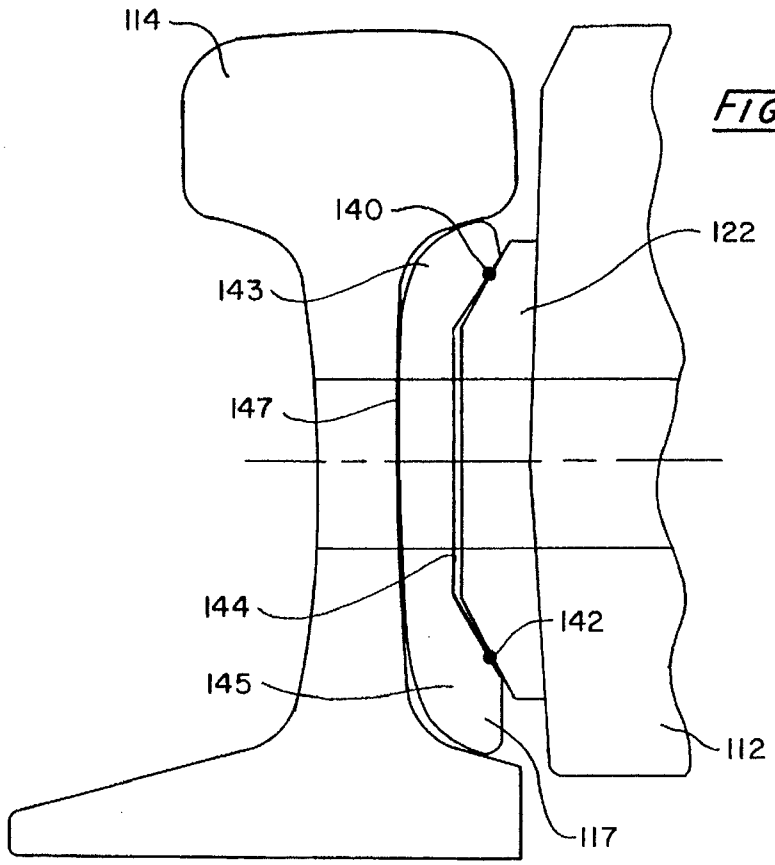
FIG. 5 is an enlarged and cross-sectioned elevation view of a portion of the direct support type frog assembly of the present invention illustrated in a slack assembled condition.

FIG. 5 illustrates in detail a representative spacer element 117, etc. in its relationship to a co-operating assembly wing rail 114, etc. and to a co-operating frog casting lug element 122 in an intermediate or slackly assembled condition whereas FIG. 6 illustrates a fully tightened assembly (nut and bolt not shown for clarity). We prefer to construct spacer element 117, etc. with a configuration that will allow it to adjust to accommodate any rail dimensional deviation within tolerance. FIG. 5 more clearly illustrates the cross-sectional profiles that we prefer for representative adjustable spacer element 117, etc. and their relation to the co-operating similar profiles of assembly elements 114 and 122. It is preferred that adjustable spacer element 117 be configured with an initial shape somewhat distorted from its theoretical ideal shape such that the co-operating surfaces of elements 117 and 122 have an initial point or edge contact (before final tightening of assembly fastener element 118) at the top and bottom 145 of spacer element 117 thus leaving an intermediate gap or adjustment zone or range between the component parts. The point or edge contact is illustrated by points 140 and 142 in FIG. 5 and the gap or adjustment range or zone is designated by the reference numeral 144. Additional gaps also occur between spacer element 117 and wing rail 114 adjacent the top 143 and bottom 145 of spacer element 117. It is intended that a threaded fastener not shown inserted through holes in components 112, 117 and 114 be utilized to draw the components tightly together.

Upon final tightening of assembly 100 the top 143 and bottom 145 of each spacer element 117, etc. are rotated as the face of a lug element 122 is moved through the adjustment range 144 to bring the co-operating surfaces of wing rail 114 and spacer element 117 into fuller contact. As this occurs the angled surfaces at the top 143 and bottom 145 of the spacer element 117 become more closely compliant with their matching angled surfaces of the casting lug element 122. Also, the flat vertical surface of the spacer element 117 and the mating vertical surface of the casting lug element 122 will likewise come into contact.

On occasion the curved outer center surface 147 on the spacer element 122 will conform or bottom out against the web of a deviant wing rail 114 before the co-operating interfaces of spacer element 117 and casting lug element 122 are fully engaged. When this occurs a second mechanical action takes place, i.e., material compression. Because the gap or adjustment zone 144 has not been fully closed, the contact area between spacer element 117 and casting lug element 122 remains very small—an edge contacting a surface. Thus, the clamping forces created by the torque applied to the threaded fastener (approximately eighty percent of the ultimate yield strength of the bolt) are concentrated into a small area of the spacer element 117 at 140 and 142, exceeding the material's crush resistance and resulting in compression thereof. As the material crushes the contact area increases. As the gaps between the spacer element 117 and the casting lug element 122 close the surface area of contact therebetween reaches a maximum designed level. When this occurs, the clamping force is spread over the relatively large contact area and falls below the crush resistance value of the material of spacer element 117 allowing the designed torque values for the assembly to be achieved. Because the adjustable spacer element 117 can deform and thus readily accommodate deviant wing rail structures, the resulting frog assemblies are tighter, more easily assembled and more resistant to loosening of fasteners in use.

The principal manufacturing advantage of using the disclosed construction for the improved direct support type frog assemblies is a significant reduction of the costs otherwise associated with the casting, machining, and inventorying of core frog castings for a range of differently sized frog assemblies. With the new frog assembly only one casting configuration and size is required for numerous different frog assembly rail size applications. A major contribution to the reduced costs are the reduced number of different casting mold cavity patterns required, the uniform core frog casting machining sequence that becomes applicable to a range of different frog assembly sizes, and the necessity of having to inventory fewer different sizes of frog castings. Also, use of the disclosed improved frog assembly construction permits the standardization of hole location below the rail tread surface at a constant distance for all the different co-operating wing rail sizes.

Variations or changes may be made in the materials utilized and in the relative shapes and sizes of the different component parts of the claimed invention without departing from the letter or spirit of the claims.

We claim our invention as follows:

1. A railroad trackwork frog assembly comprising:

a base plate element;

a core frog casting supported by the base plate element and having tread surfaces;

a pair of compliant spacer elements having surfaces contacting said core frog casting at laterally opposed sides of the core frog casting;

a pair of wing rails directly supported by said base plate element, having tread surfaces, and respectively contacting said compliant, spacer elements; and fasteners joining said core frog casting, said pair of compliant spacer elements, and said pair of wing rails into a rigid unitary structure with said core frog casting and said pair of wing rails having co-planar tread surfaces wherein each of said spacer elements is made of a material such that when the fasteners are installed, the spacer element surfaces are deformed to conform to the shape of an adjacent core frog casting complementary surface and an adjacent wing rail complementary mating surface.

2. The railroad trackwork frog assembly invention defined by claim 1 wherein said core frog casting and said pair of wing rails have the same vertical height.

3. The railroad trackwork frog assembly invention defined by claim 1 and further comprising aligned openings in said core frog casting, said compliant, spacer elements, and said wing rails for receiving said fasteners, said aligned openings having a cross-sectional size and configuration that provides a clearance for said fasteners.

4. The railroad trackwork frog assembly invention defined by claim 1 wherein said compliant spacer elements are comprised of a molded non-metallic material.

5. The railroad trackwork frog assembly invention defined by claim 1 wherein said compliant spacer elements are comprised of a metallic material.

6. The railroad trackwork frog assembly invention defined by claim 1 wherein said compliant spacer elements are formed from a material having an ultimate compressive stress value less than that of said core frog casting and said wing rails and greater than the clamping force exerted by said fasteners.

7. A railroad trackwork frog assembly comprising:

a base plate element;

a core frog casting supported by the base plate element and having tread surfaces;

a pair of compliant spacer elements contacting said core frog casting at laterally opposed sides of the core frog casting;

a pair of wing rails directly supported by said base plate element, having tread surfaces, and respectively contacting said compliant, spacer elements;

fasteners joining said core frog casting, said pair of compliant spacer elements, and said pair of wing rails into a rigid unitary structure with said core frog casting and said pair of wing rails having co-planar tread surfaces; and wherein each one of said pair of wing rails has a vertical height that is greater than the vertical height of said core frog casting, and wherein said assembly has a metallic riser element positioned intermediate said core frog casting and said base plate element.

8. A railroad trackwork frog assembly comprising:

a base plate element;

a core frog casting supported by the base plate element and having tread surfaces;

a pair of compliant spacer elements contacting said core frog casting at laterally opposed sides of the core frog casting;

a pair of wing rails directly supported by said base plate element, having tread surfaces, and respectively contacting said compliant, spacer elements;

fasteners joining said core frog casting, said pair of compliant spacer elements, and said pair of wing rails into a rigid unitary structure with said core frog casting and said pair of wing rails having co-planar tread surfaces; and wherein said core frog casting has a pair of opposite tapered lug elements, and wherein said pair of spacer elements have a configuration such that complementary mating surfaces of said spacer elements make essentially only edge contacts with said core frog casting tapered lug elements when said spacer elements are initially engaged with said core frog casting prior to tightening the fasteners.

9. The railroad trackwork frog assembly as defined in claim 8 wherein said pair of spacer elements are made of material such that said complementary mating surfaces are deformed and make broad surface to surface contact with said core frog casting tapered lug elements when said fasteners are tightened and said trackwork frog assembly is finally assembled.

* * * * *